US009453286B2

(12) United States Patent
Tremblay et al.

(10) Patent No.: US 9,453,286 B2
(45) Date of Patent: Sep. 27, 2016

(54) METHOD AND SYSTEM FOR ELECTROLYSER SINGLE CELL CURRENT EFFICIENCY

(75) Inventors: Gilles Tremblay, Montréal (CA); Helmut Lademann, Hürth (DE); Said Berriah, Laval (CA); Michel Veillette, St-Bruno (CA)

(73) Assignee: RECHERCHE 2000 INC., Montreal, QC (CA)

( * ) Notice: Subject to any disclaimer, the term of this patent is extended or adjusted under 35 U.S.C. 154(b) by 1084 days.

(21) Appl. No.: 13/263,943

(22) PCT Filed: Apr. 16, 2010

(86) PCT No.: PCT/CA2010/000595

§ 371 (c)(1),
(2), (4) Date: Jan. 19, 2012

(87) PCT Pub. No.: WO2010/118533

PCT Pub. Date: Oct. 21, 2010

(65) Prior Publication Data

US 2012/0138483 A1 Jun. 7, 2012

Related U.S. Application Data

(60) Provisional application No. 61/169,743, filed on Apr. 16, 2009.

(51) Int. Cl.

| | |
|---|---|
| ***G01N 27/28*** | (2006.01) |
| ***C25B 15/02*** | (2006.01) |
| ***C25C 7/06*** | (2006.01) |

(52) U.S. Cl.
CPC *C25B 15/02* (2013.01); *C25C 7/06* (2013.01)

(58) Field of Classification Search
CPC ..... G01N 27/28
USPC ..... 205/775; 204/406
See application file for complete search history.

(56) References Cited

U.S. PATENT DOCUMENTS

2006/0289312 A1* 12/2006 Tremblay et al. ..... 205/335

OTHER PUBLICATIONS

Tremblay, G.J.; "Intelligent Systems & the Chlor Alkali Industry: Realizing Maximum Efficiencies", Montreal, Quebec, Canada, technical presentation at CloroSur 2007 annual meeting, Oct. 16, 2007.

Cammarota et al.; "The Calculation of Cathode Current Efficienty and Metal Loss in a Small Alumina Reduction Cell", College Park Metallurgy Research Center, US Departmentg of the Interior, College Park, Maryland, vol. 117, No. 2, Feb. 1970, pp. 282-288.

Jaksic, M.M.; "Mutual Effect of Current Density, pH, Temperature, and Hydrodynamic Factors on Current Efficiency in the Chlorate Cell Process", Electrochemisty Department, Institute for Chemistry, Technology and Metallurgy, Belgrade, Yugoslavie, vol. 121, No. 1, Jan. 1974, pp. 70-79.

Iwai et al.; "Numerical Prediction of System Efficiency of Solid Oxide Redox Flow Battery During Charge Discharge Process", The Electrochemical Society, ECS Transactions, vol. 57, No. 1, pp. 2661-2670, 2013.

Tremblay et al.; "Electrode Management Optimisation System", Modern Chlor-Alkali Technology, 2001, Society of Chemical Industry, vol. 8, pp. 105-113.

* cited by examiner

*Primary Examiner* — Eric S Dejong
*Assistant Examiner* — G. Steven Vanni
(74) *Attorney, Agent, or Firm* — Norton Rose Fulbright Canada LLP

(57) ABSTRACT

There is described a method for determining single cell current efficiency in an electrolyzer, the method comprising: measuring voltage of a plurality of single cells in the electrolyzer; measuring electrolyzer current feeding the single cells; detecting one of a shutdown period and a start-up period; and for each single cell: determining a time t taken for a voltage level to reach a predetermined occurrence in a voltage curve after a polarization current has been triggered; and calculating cell current efficiency as a function of the time t.

18 Claims, 6 Drawing Sheets

METHOD AND SYSTEM FOR ELECTROLYSER SINGLE CELL CURRENT EFFICIENCY

CROSS-REFERENCE TO RELATED APPLICATIONS

This application claims priority under 35 USC 119(e) of U.S. Provisional Patent Application bearing Ser. No. 61/169,743 filed on Apr. 16, 2009, the contents of which are hereby incorporated by reference.

TECHNICAL FIELD

The present invention relates to the field of electrolyser cells and more particularly, to efficiency determination for individual cells in an electrolyser.

BACKGROUND OF THE ART

An electrolyser is an apparatus where an electrolysis reaction takes place. Electrolysis is the process of decomposing a chemical compound into its elements or producing a new compound by the action of an electrical current. An electrolyser cell is typically composed of two electrodes and a separator, and multiple cells are used to achieve a desired electrolysis process.

A significant reduction in cell current efficiency may be caused by damages to the cell membrane. These damages commonly result from holes caused by voids, blisters and delamination due to faults in startup and shutdown procedures, electrolyte contaminants, or as a consequence of the normal aging process. These damages will, in the end, affect the cell through shortcomings such as significant back-migration of sodium hydroxide in the anode compartment and consequently affect the quality of the produced chlorine (oxygen evolution), and increase the risk of shortcuts between the anode and the cathode, thereby causing structural damages to the cell. Corrosion of the anode due to the imbalanced pressure between the anodic and the cathodic compartment may be another possible shortcoming.

Known methods of measuring electrolyser efficiency involve chemical analysis on a global basis. However, such methods do not allow identification of an individual cell's efficiency. Therefore, there is a need to determine efficiency on a cell-by-cell basis.

SUMMARY

In accordance with a first broad aspect, there is provided a method for determining single cell current efficiency in an electrolyser, the method comprising: measuring voltage of a plurality of single cells in the electrolyser; measuring electrolyser current feeding the single cells; detecting one of a shutdown period and a start-up period; and for each single cell: determining a time t taken for a voltage level to reach a predetermined occurrence in a voltage curve after a polarization current has been triggered; and calculating cell current efficiency as a function of the time t.

In accordance with a second broad aspect, there is provided a system for determining single cell current efficiency in an electrolyser, the system comprising: a processor in a computer system; a memory accessible by the processor; and at least one application coupled to the processor and configured for: measuring voltage of a plurality of single cells in the electrolyser; measuring electrolyser current feeding the single cells; detecting one of a shutdown period and a start-up period; and for each single cell: determining a time t taken for a voltage level to reach a predetermined occurrence in a voltage curve after a polarization current has been triggered; and calculating cell current efficiency as a function of the time t.

In accordance with a third broad aspect, there is provided a software product embodied on a computer readable medium and comprising instructions for determining single cell current efficiency in an electrolyser, comprising: a measuring module for receiving voltage and current measurements of a plurality of single cells in the electrolyser; a detection module coupled to the measuring module for detecting one of a shutdown period and a start-up period; and a calculation module receiving input from the measuring module and the detection module and adapted for determining a time t taken for a voltage level to reach a predetermined occurrence in a voltage curve after a polarization current has been triggered, and for calculating cell current efficiency as a function of the time t.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
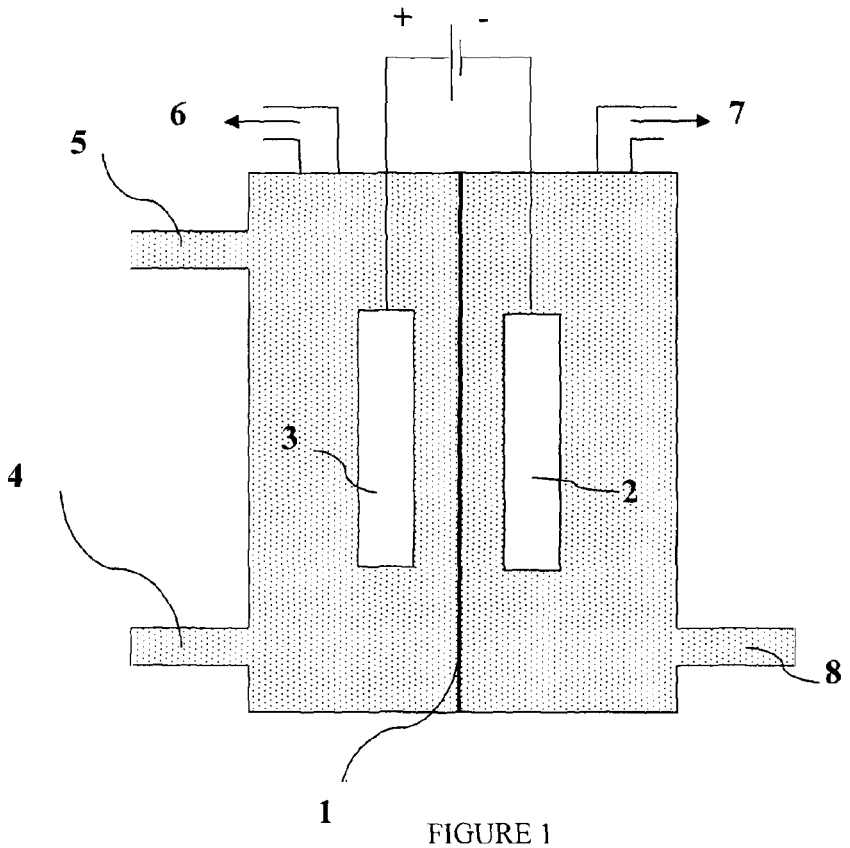
FIG. 1 illustrates an exemplary embodiment for an individual electrolyser cell.

FIG. 1 illustrates a typical electrolyser cell. A membrane 1 separates a cathode 2 from an anode 3. In this example, saturated brine (sodium chloride, NaCl) is provided via a first input 4 at the anode side of the cell 3, and chloride ions ($Cl^-$) are oxidized to chlorine ($Cl_2$) and output via a first output 6. At the cathode side of the cell 2, water is reduced to hydrogen ($H_2$) and Hydroxide ions ($OH^-$). The hydrogen is output via a second output 7. The Hydroxide ions ($OH^-$) combine with the sodium ions ($Na^+$) that migrate through the membrane from the anode side, to form caustic soda (NaOH) in the cathode 2 compartment that is output via another output 8.

In the Chlor-alkali industry, primary products of electrolysis are Chlorine, Hydrogen, and Sodium Hydroxide solution (commonly called "caustic soda" or simply "caustic"). Three main electrolysis processes are used in the Chlor-Alkali industry based on the type of separator: ion exchange membrane, permeable diaphragm and cathode mercury. The ion exchange membrane technology has been shown to result in lower power consumption and the absence of an environmental impact compared to the mercury plants. In the Chlorate industry, Sodium Chlorate or Sodium Hypochlorite is produced from the electrochemically generated chlorine and caustic soda with no separator in the electrolysis cell.

The electrolysis process of aqueous solutions of sodium chloride for producing chlorine and caustic hydroxide is described by the following equation:

$$2NaCl+2H_2O \rightarrow Cl_2+H_2+2NaOH$$

Figure 2:
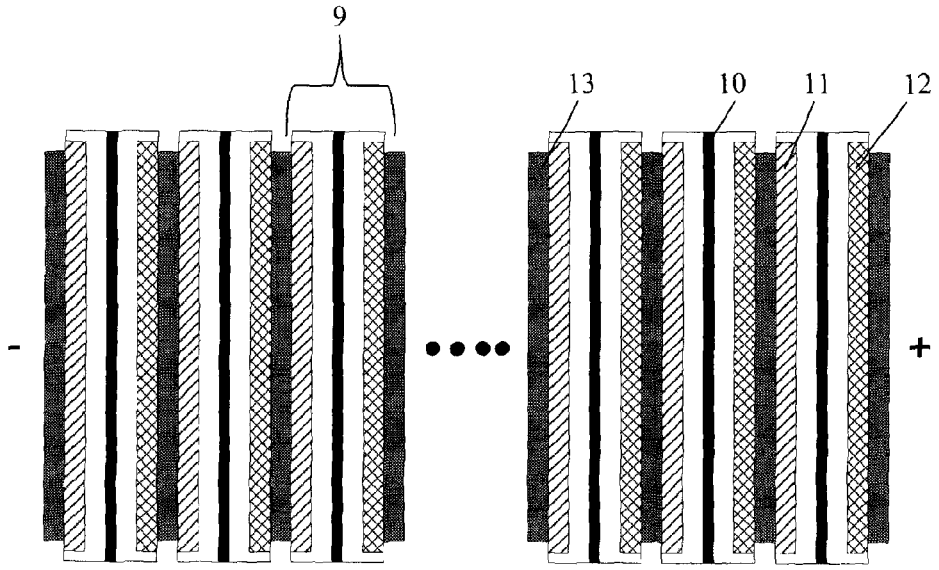
FIG. 2 illustrates an exemplary embodiment of a plurality of bipolar electrolyser cells provided in series.
Figure 3:
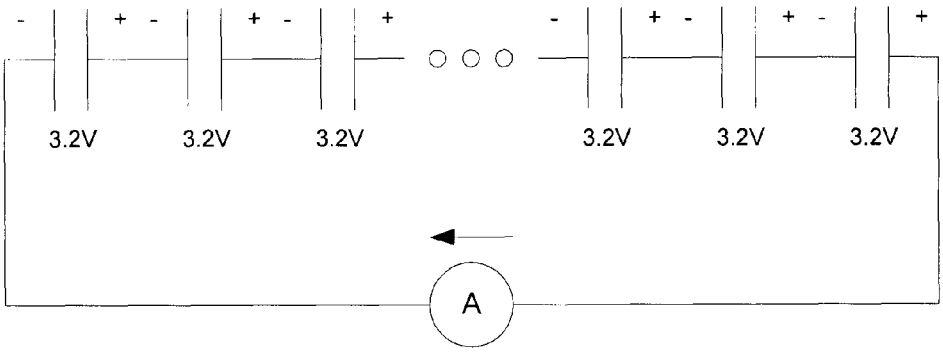
FIG. 3 is a circuit diagram of the electrolyser illustrated in FIG. 2.

On an industrial scale, electrolysers may be operated in two configurations: bipolar or monopolar. Bipolar membrane electrolysers are composed of a number of cells connected in series, as illustrated in FIG. 2. An electrolysis voltage is imposed across the entire row, and current flows through a bus bar 13 of the row from anode 11 to cathode 12 of each cell 9 and then to the anode of the next adjacent cell in the row. The equivalent circuit of a bipolar electrolyser is illustrated in FIG. 3.

Alternatively, the monopolar electrolysers comprise a row of separate elementary cells where all the anodes are connected to a common positive pole and the cathodes to a common negative pole.

Depending on the chemical plant requirements, the number of cells can vary significantly, such as between 1 and 200 cells per electrolyser. The chemical potential required for the reaction to take place is generally around 2 to 4 V DC, so the total potential of an electrolyser from end to end can nominally reach 800 V DC. The current required for the process depends on the surface of the electrodes and the desired production rate. Generally, electrolysers may be operated between 2 and 7 kA/m$^2$. The electrodes may be coated with catalysts, to reduce the specific power consumption. The anodes may consist of a titanium substrate with noble metal oxides. The cathodes may consist of a nickel substrate with noble metal oxides. A typical industrial elementary electrolytic cell has an electrode surface between 0.5 and 5 square meters.

The energy consumption in kWh to produce one ton of product results from the following:

$$E = \frac{n \times F \times U_{Cell}}{3600 \times CE \times M}$$

Wherein n: Number of Faraday's required per molecular weight of the product (2 for chlorine)

F: Faraday constant $U_{Cell}$: Cell Voltage

CE: Current Efficiency

M: Molecular weight of the product in kg.

The current efficiency CE at least partly depends on the type of membrane. Typically, CE values for a bi-layer membrane range from 95% to 97% efficiency. The typical energy consumption of an electrolysis plant is 2100 to 2500 kWh per ton of chlorine using membrane cells. As can be seen from the above equation, a reduction in the current efficiency increases the energy consumption.

Figure 4:
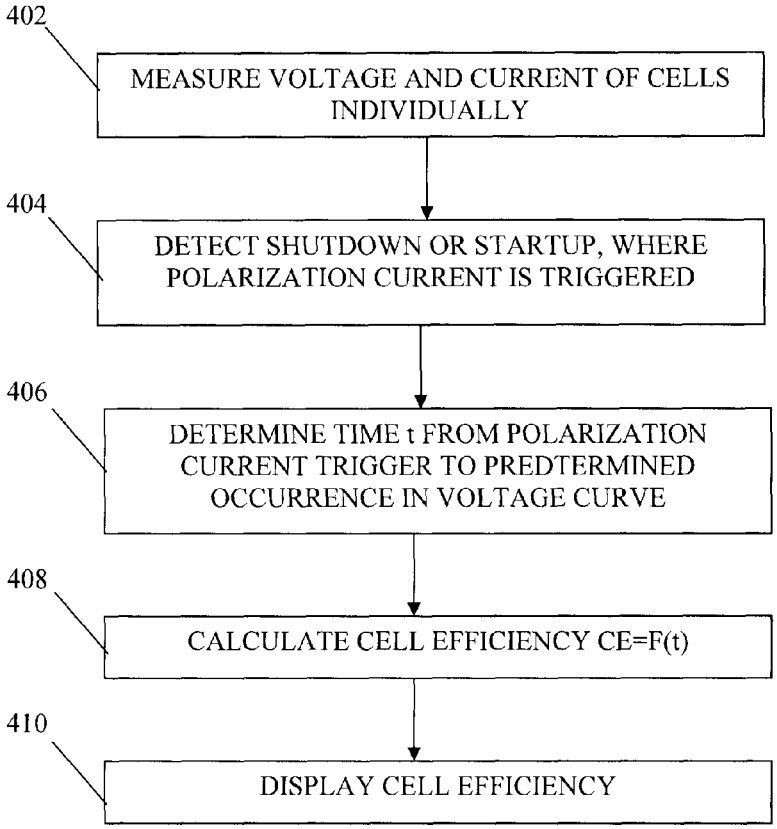
FIG. 4 is a flowchart illustrating a method for determining single cell current efficiency in an electrolyser, in accordance with one embodiment.

FIG. 4 illustrates a method for determining individual cell efficiency in an electrolyser. A first step consists in measuring voltages and currents of the individual cells in the electrolyser 402. Various methods of performing such measurements can be used, such as the methods described in U.S. Pat. No. 6,591,199, the contents of which are hereby incorporated by reference. Individual measurements are therefore obtained for voltage and current for each cell in the electrolyser.

Figure 7:
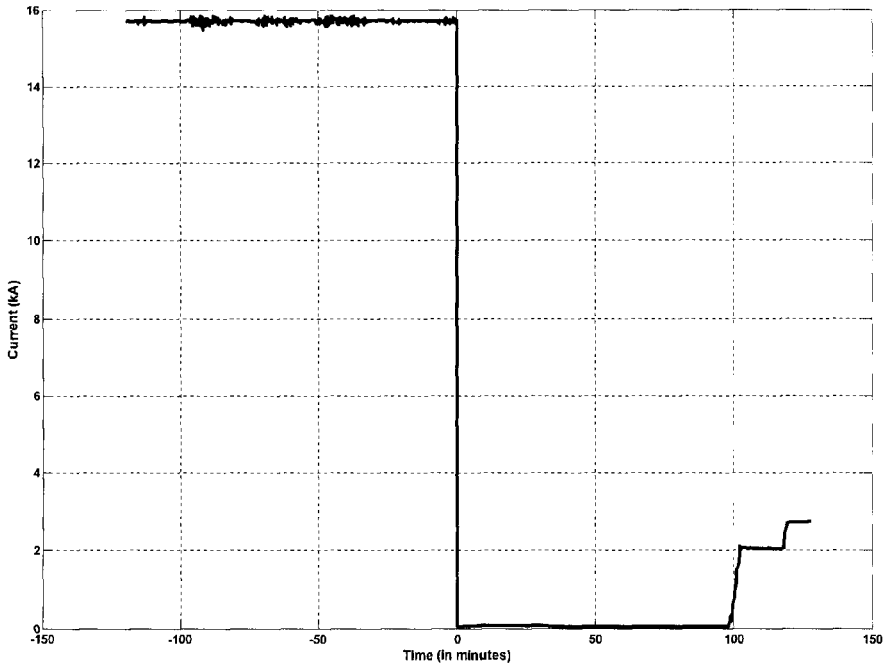
FIG. 7 is a graph illustrating an exemplary embodiment of current in the electrolyser before and after a shutdown.
Figure 9:
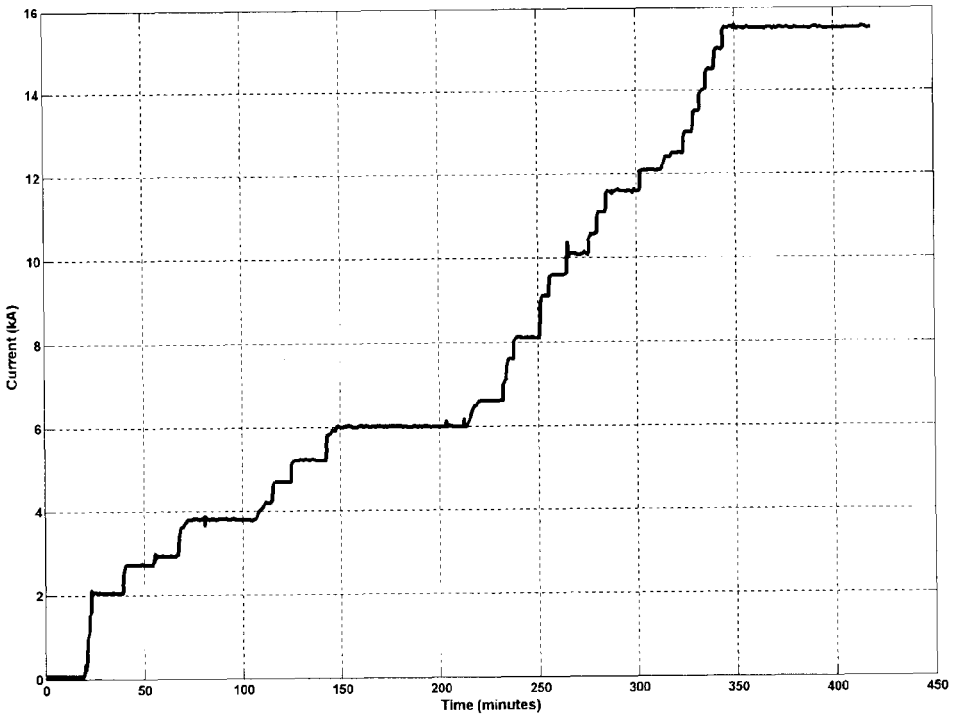
FIG. 9 is a graph illustrating an exemplary embodiment of current in the electrolyser before and after a startup.

The next step in the method consists in detecting either a shut down or a startup of the electrolyser 404. A shutdown period occurs when a load is removed substantially to 0%. FIG. 7 illustrates an exemplary current curve and time t=0 corresponds to the point in time when the load is removed. In this example, the current drops from 18 kA to virtually 0 A and is maintained at that value for 100 minutes. FIG. 9 illustrates another exemplary current curve, this time during a startup period. The load is provided at time t=0 minutes and it increases progressively until it reaches 100% at 18 kA. A startup period may be qualified as occurring when the current load is increased from 0 to 20% within a time period of approximately 60 minutes. Startup may also be qualified if the current load reaches 20% in less than 60 minutes.

Figure 8:
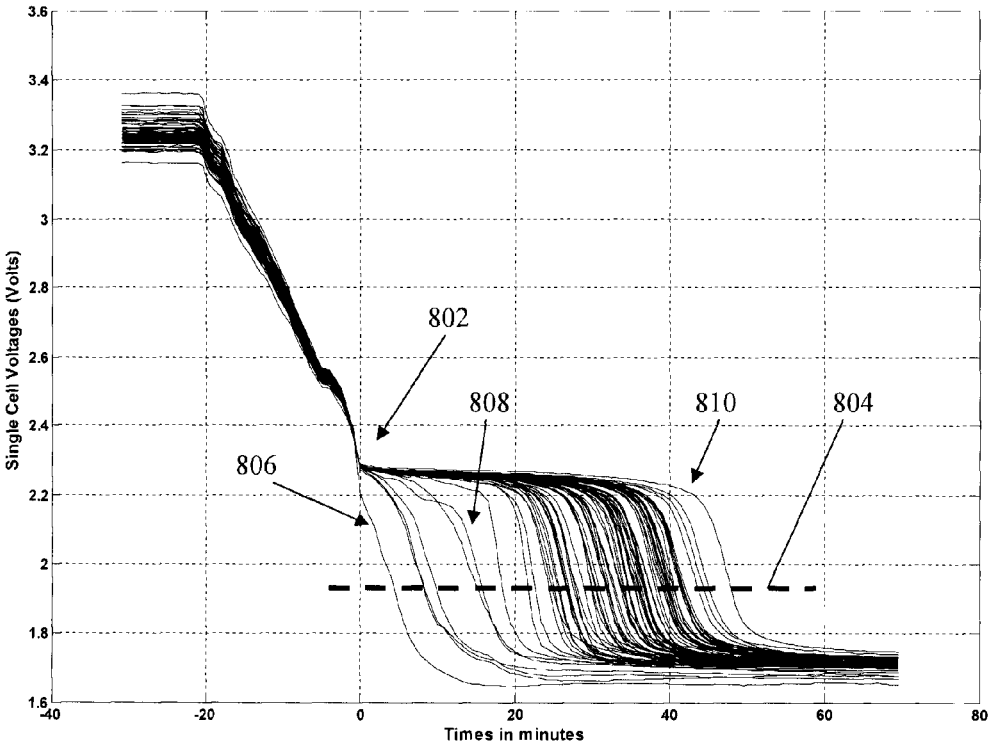
FIG. 8 is a graph illustrating an exemplary embodiment of voltage in the electrolyser before and after a shutdown.
Figure 10:
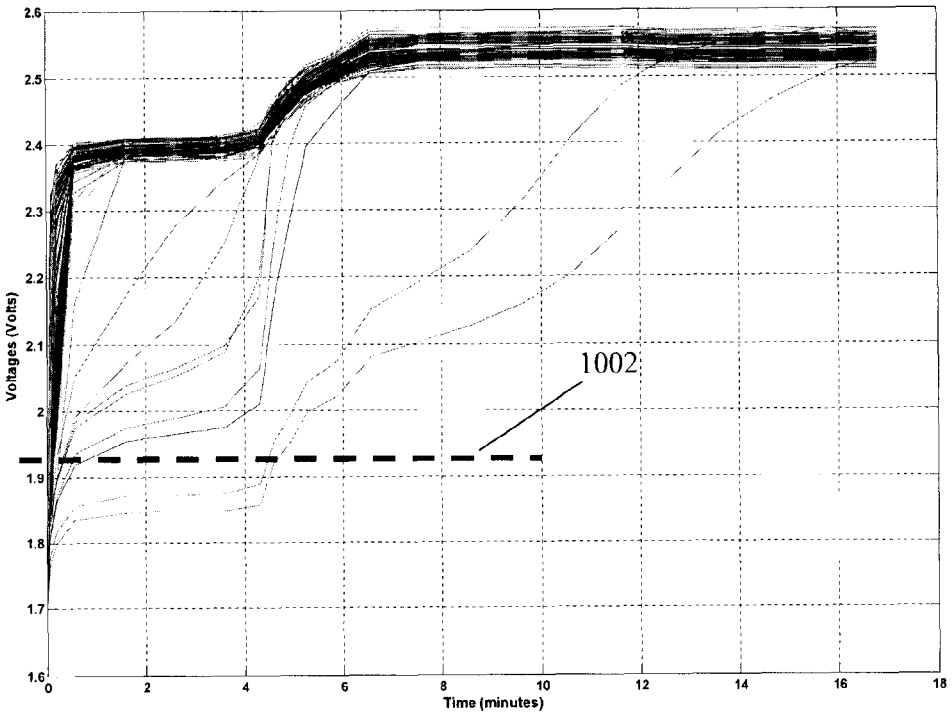
FIG. 10 is a graph illustrating an exemplary embodiment of voltage in the electrolyser before and after a startup.

A polarization current is triggered when the load reaches 0%. FIG. 8 illustrates the voltage behavior for each cell in the electrolyser when the polarization current is triggered 802 during shutdown. As is illustrated, the voltage of each individual cell in the electrolyser will independently react to the shutdown. Similarly, FIG. 10 illustrates the voltage behavior for each cell in the electrolyser when polarization current is triggered during startup. In this case, the polarization current effect begins essentially at time t=0, i.e. at the beginning of startup.

Once the shutdown or startup period has been detected, individual cell efficiency may be determined using two steps. In a first step, the time t taken for the voltage level to reach a predetermined occurrence in the voltage curve after the trigger point 802 is determined 406. Cell efficiency CE may then be calculated as a function of the time t 408, CE=f(t).

In case of a shutdown, cells that take longer to reach the predetermined occurrence are found to have higher efficiency than cells that reach the predetermined occurrence in a shorter time frame. Therefore, in the example illustrated in FIG. 8, CE of curve 806<CE of curve 808<CE of curve 810. The function f(t) may be a straight comparison between the different times and efficiency is provided as a comparative ranking. Alternatively, a target efficiency is established with a known time $t_{target}$ and the measured times are compared to $t_{target}$ and ranked accordingly.

In one embodiment, CE versus t formula f is calculated using an empirical model derived from a nonlinear regression of values provided by a numerical simulation, while taking into account a plurality of electrolyser characteristics. These characteristics may be, for example, polarization current level, anode compartment volume, membrane area, full load level, brine flow rate, brine acidity, brine redox potential, caustic strength, voltage, and pH.

In some cases, the presence of stray current in certain types of electrolysers, due to their design, may cause a loss of efficiency. In these case, the calculation used to determine cell efficiency may be modified to consider a specific polarization current for each individual cell.

In one embodiment, the formula used has the form of $CE=P_1+P_2*\log(P_3*t)+P_4*t^{P5}$, $P_1$, $P_2$, $P_3$, $P_4$, and $P_5$ are regression parameters. For example, using the following exemplary regression parameters:

P1:98.6313491
P2:0.31263139
P3:57.9920046
P4:30.0224603
P5:1.07236003 and using the exemplary measured times of $t_{806}$=5 minutes, $t_{808}$=15 minutes, $t_{810}$=40 minutes, we can find the following CE values: $CE_{806}$=94%, $CE_{808}$=97.9, $CE_{810}$=99.

Measured times may vary between less than 5 minutes and more than 40 minutes. Using the above regression parameters, a time of less than 10 minutes results in an efficiency below 94% and a time of greater than 10 minutes results in a CE above 94%.

The cells may be categorized into two categories, namely efficient and not efficient, based on a user-defined acceptable threshold for efficiency. Alternatively, the cells may be categorized into more than two categories, such as three categories (efficient, under-performing, faulty), four categories (efficient, slightly under-performing, very under-performing, and faulty), or more.

In one embodiment, the predetermined occurrence on the curve, illustrated as 804 in FIGS. 8 and 1002 in FIG. 10, may correspond to an inflection point on the curve where the derivative is zero. In another embodiment, the second derivative may be used. In another alternative embodiment, the predetermined occurrence corresponds to a specific preset value, such as 1.85V, 1.9V, 1.95V, etc. This value may be user-selected via a user interface provided by the system, which will be explained in more detail below. Other methods of finding and/or setting the predetermined occurrence on the voltage curve will be understood by those skilled in the art.

Figure 11:
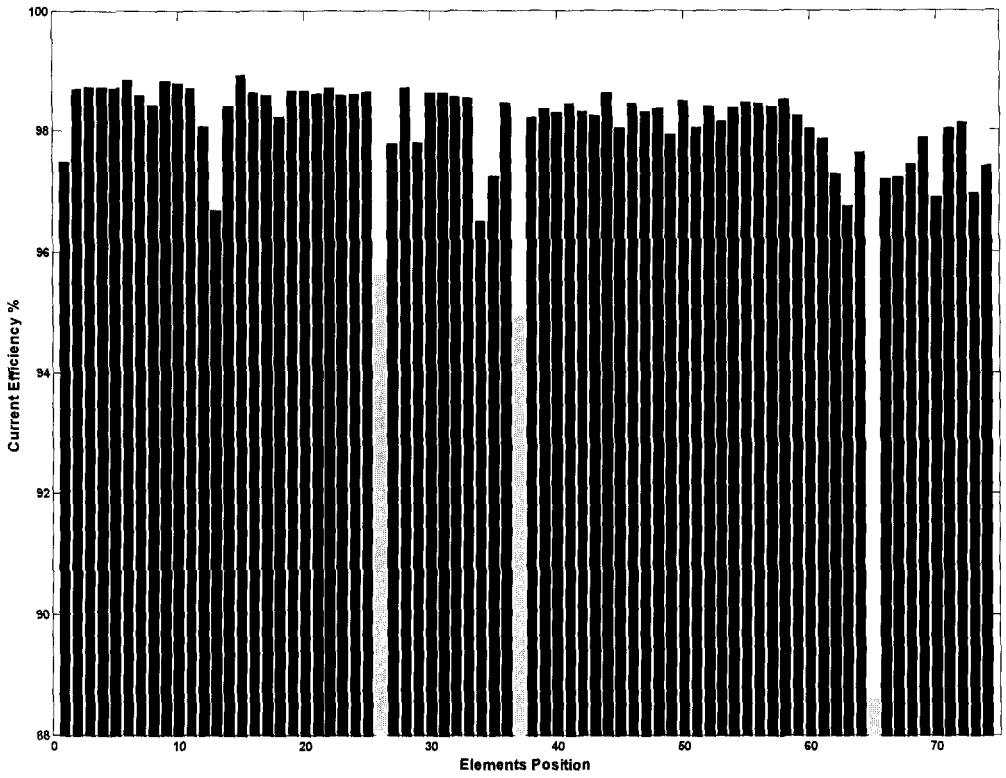
FIG. 11 is a graph illustrating an exemplary embodiment of cell efficiency for each individual cell in the electrolyser.

In one embodiment of the method, cell efficiency is displayed 410. An exemplary embodiment for this is illustrated in FIG. 11. Cell efficiency is plotted with respect to a cell position in the electrolyser, and under performing cells are highlighted either in a visually coded manner (color) or by having a numerical value displayed for those cells that are below the threshold (not shown). Other ways of displaying the performance of each cell will be understood by those in the art.

Figure 5:
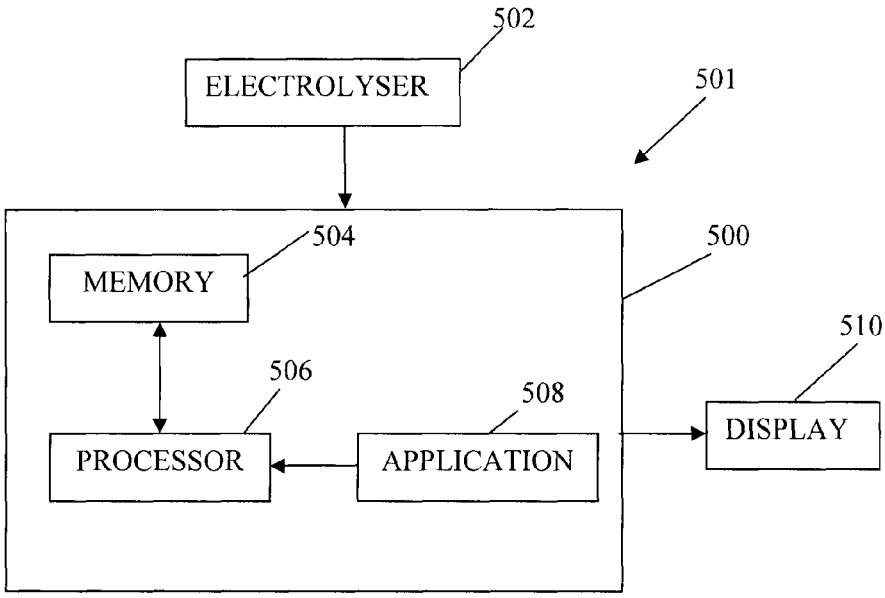
FIG. 5 is a block diagram illustrating a system for determining single cell current efficiency in an electrolyser, in accordance with one embodiment.

FIG. 5 illustrates an exemplary embodiment for a system for determining individual cell efficiency in an electrolyser 501. A computer system 500 comprises an application 508 running on a processor 506, the processor being coupled to a memory 504. An electrolyser 502 is connected to the computer system 500. This connection may be wired or wireless and various communication protocols may be used between the electrolyser 502 and the computer system 500. The electrolyser 502 comprises a plurality of individual electrolyser cells (not shown).

The memory 504 accessible by the processor 506 receives and stores data, such as measured voltages, measured currents, measured times, cell efficiencies, and any other information used by the system 501. The memory 504 may be a main memory, such as a high speed Random Access Memory (RAM), or an auxiliary storage unit, such as a hard disk, a floppy disk, or a magnetic tape drive. The memory may be any other type of memory, such as a Read-Only Memory (ROM), or optical storage media such as a videodisc and a compact disc.

The processor 506 may access the memory 504 to retrieve data. The processor 506 may be any device that can perform operations on data. Examples are a central processing unit (CPU), a front-end processor, a microprocessor, a graphics processing unit (GPU/VPU), a physics processing unit (PPU), a digital signal processor, and a network processor. The application 508 is coupled to the processor 506 and configured to perform various tasks as explained below in more detail. An output may be transmitted to a display device 510.

Figure 6:
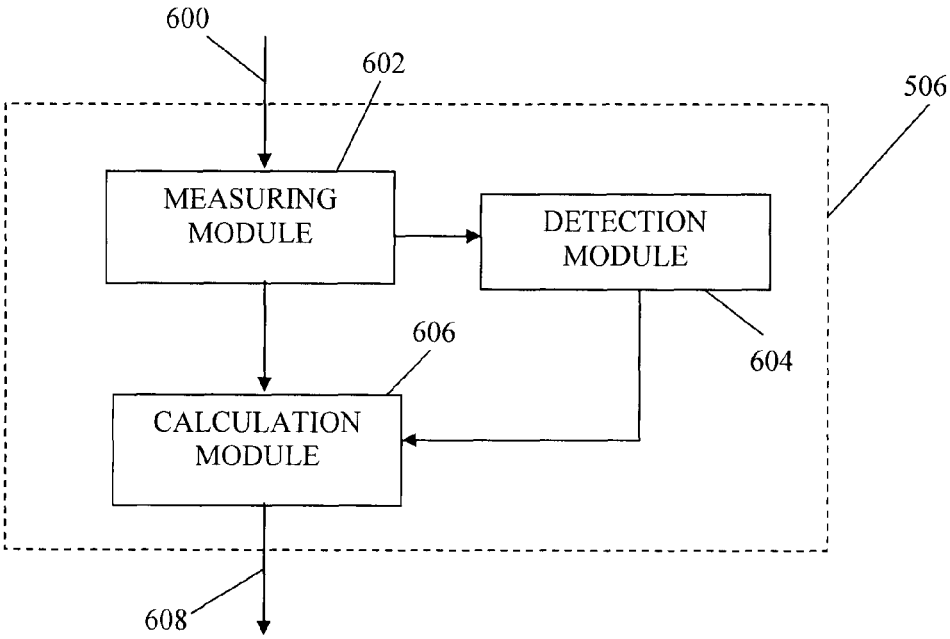
FIG. 6 is a block diagram illustrating an exemplary embodiment for the application of the system of FIG. 5.

FIG. 6 is an exemplary embodiment of the application 508 found in the computer system 500 of the system 801. A measuring module 602 receives measurement data 600 from the electrolyser 502, the measurement data 600 corresponding to voltage and/or current measurements for each cell individually. As stated above, various measurement techniques may be used to obtain the individual cell measurements.

The measuring module 602 is coupled to a detection module 604 that can detect, using the measured currents and voltages, a startup or a shutdown period of the electrolyser, upon which a polarization current is triggered. Both the measuring module 602 and the detection module 604 are coupled to a calculation module 606, which is adapted to determine, for each electrolyser cell individually, a time t taken for a voltage level to reach a predetermined occurrence in a voltage curve after polarization current has been triggered. This time t is then used to calculate cell efficiency, as per the embodiments described above.

In one embodiment, the calculation module uses an empirical model derived from a nonlinear regression of values provided by a numerical simulation taking into account a plurality of electrolyser characteristics to calculate cell efficiency versus time formula.

In another embodiment, the calculation uses an equation of the form: $CE=P_1+P_2*\log(P_3*t)+P_4*t^{P5}$, where $P_1$, $P_2$, $P_3$, $P_4$, and $P_5$ are regression parameters.

It should be understood that the modules illustrated in FIG. 6 may be provided in a single application 508 or a combination of 2 or more applications coupled to the processor 506. While illustrated in the block diagram of figures and 6 as groups of discrete components communicating with each other via distinct data signal connections, it will be understood by those skilled in the art that the embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present embodiments.

The embodiments of the invention described above are intended to be exemplary only. The scope of the invention is therefore intended to be limited solely by the scope of the appended claims.

We claim:

1. A method for determining single cell current efficiency in an electrolyser, the method comprising:

measuring voltage of a plurality of single cells in the electrolyser;

measuring electrolyser current feeding the single cells;

detecting one of a shutdown period and a start-up period using the electrolyser current as measured;

once the shutdown or start-up period has been detected, for each single cell:

determining, from the voltage as measured, a time t taken for a voltage level to reach a predetermined occurrence in a voltage curve after a polarization current has been triggered during the shutdown or startup period; and calculating cell current efficiency as a function of the time t, wherein:

at shutdown, cells that take longer to reach the predetermined occurrence are classified as more efficient than cells that take less time; and at startup, cells that take longer to reach the predetermined occurrence are classified as less efficient than cells that take less time; and operating the electrolyser while taking into account cell classification for current efficiency.

2. The method of claim 1, wherein said calculating cell current efficiency comprises using an empirical model derived from a nonlinear regression of values provided by a numerical simulation taking into account a plurality of electrolyser characteristics.

3. The method of claim 2, wherein said calculating cell current efficiency comprises using a formula having the form of: $CE=P_1+P_2*\log(P3*t)+P4*t^{P5}$, $P_1$, $P_2$, $P_3$, $P_4$, and $P_5$ being regression parameters.

4. The method of claim 2, wherein the plurality of electrolyser characteristics are selected from a group comprising polarization current level, anode compartment volume, membrane area, full load level, brine flow rate, brine acidity, brine redox potential, caustic strength, voltage, and pH.

5. The method of claim 1, further comprising displaying cell current efficiency for all of said single cells while highlighting cells that do not meet a predetermined efficiency threshold.

6. The method of claim 5, wherein said highlighting cells comprises classifying said single cells into three categories, the three categories being high efficiency, underperforming, and faulty.

7. The method of claim 1, wherein the predetermined occurrence in the voltage curve corresponds to a point where a derivative is zero.

8. The method of claim 1, wherein the predetermined occurrence in the voltage curve corresponds to a point where a second derivative is zero.

9. The method of claim 1, wherein the predetermined occurrence in the voltage curve corresponds to a point at which the voltage reaches a predetermined value.

10. The method of claim 1, wherein said calculating cell current efficiency comprises using a specific polarization current for each single cell.

11. A system for determining single cell current efficiency in an electrolyser, the system comprising:

a processor in a computer system;

a memory accessible by the processor; and at least one application coupled to the processor and configured for:

measuring voltage of a plurality of single cells in the electrolyser;

measuring electrolyser current feeding the single cells;

detecting one of a shutdown period and a start-up period using the electrolyser current as measured;

once the shutdown or start-up period has been detected, for each single cell:

determining, from the voltage as measured, a time t taken for a voltage level to reach a predetermined occurrence in a voltage curve after a polarization current has been triggered during the shutdown or startup period; and calculating cell current efficiency as a function of the time t, wherein:

at shutdown, cells that take longer to reach the predetermined occurrence are classified as more efficient than cells that take less time; and at startup, cells that take longer to reach the predetermined occurrence are classified as less efficient than cells that take less time; and highlighting cells classified as less efficient on a graphical user interface.

12. The system of claim 11, further comprising a display device adapted to receive and display data representing the cell current efficiency.

13. A non-transitory computer readable medium having stored thereon program code executable by a processor for determining single cell current efficiency in an electrolyser, the program code comprising instructions for:

receiving voltage and current measurements of a plurality of single cells in the electrolyser;

detecting one of a shutdown period and a start-up period using the electrolyser current as measured;

once the shutdown or start-up period has been detected, for each single cell, determining, from the voltage as measured, a time t taken for a voltage level to reach a predetermined occurrence in a voltage curve after a polarization current has been triggered during the shutdown or startup period, and calculating cell current efficiency as a function of the time t, wherein:

at shutdown, cells that take longer to reach the predetermined occurrence are classified as more efficient than cells that take less time; and at startup, cells that take longer to reach the predetermined occurrence are classified as less efficient than cells that take less time; and highlighting cells classified as less efficient on a graphical user interface.

14. The computer readable medium of claim 13, wherein said calculating cell current efficiency uses an empirical model derived from a nonlinear regression of values provided by a numerical simulation taking into account a plurality of electrolyser characteristics to calculate cell current efficiency.

15. The computer readable medium of claim 14, wherein said calculating cell current efficiency comprises using a formula having the form of: $CE=P_1+P_2*\log(P3*t)+P4*t^{P5}$, $P_1$, $P_2$, $P_3$, $P_4$, and $P_5$ being regression parameters.

16. The computer readable medium of claim 13, wherein the predetermined occurrence in the voltage curve corresponds to a point where a derivative is zero.

17. The computer readable medium of claim 13, wherein the predetermined occurrence in the voltage curve corresponds to a point where a second derivative is zero.

18. The computer readable medium of claim 13, wherein the predetermined occurrence in the voltage curve corresponds to a point at which the voltage reaches a predetermined value.

* * * * *